United States Patent [19]

Boehlke et al.

[11] Patent Number: 4,818,311

[45] Date of Patent: Apr. 4, 1989

[54] METHODS OF AND APPARATUS FOR HEATING A MOVING METALLIC STRAND MATERIAL

[75] Inventors: Bruce B. Boehlke, Duluth, Ga.; Stephen T. Zerbs, Gretna, Nebr.

[73] Assignee: American Telephone and Telegraph Company, AT&T Technologies Inc., Berkeley Heights, N.J.

[21] Appl. No.: 5,711

[22] Filed: Jan. 21, 1987

[51] Int. Cl.[4] ..... H01B 13/00

[52] U.S. Cl. ..... 156/51; 156/50; 156/47; 148/12 A; 72/128; 72/286; 219/482

[58] Field of Search ..... 156/50, 47, 51; 72/286, 72/128; 219/492, 482, 486; 148/12 A, 12 B, 150, 154

[56] References Cited

U.S. PATENT DOCUMENTS

| | | | |
|---|---|---|---|
| 1,023,316 | 4/1912 | Hurwitz . | |
| 1,386,645 | 8/1921 | Moore . | |
| 2,479,346 | 8/1949 | Goodnow . | |
| 3,515,848 | 6/1970 | Heinz . | |
| 3,630,057 | 12/1971 | STrohmeier | 72/286 X |
| 3,826,690 | 7/1974 | Bleinberger et al. | 72/286 X |
| 3,962,898 | 6/1976 | Tillman | 72/286 X |
| 4,010,412 | 3/1977 | Forman | 219/492 X |
| 4,078,168 | 3/1978 | Kelly | 219/482 X |

*Primary Examiner*—Michael W. Ball
*Assistant Examiner*—Jeff H. Aftergut
*Attorney, Agent, or Firm*—Edward W. Somers

[57] ABSTRACT

During the heating of a moving wire (21) such as when the wire is being annealed, the wire is heated in such a manner that the energy applied to each successive increment of length of the wire is substantially constant. This is accomplished by causing an integral number of half cycles of alternating curent to be applied to each successive increment of length of the wire as the increments are moved from one sheave to another in an annealer (20). In one embodiment, the integral number of half cycles is achieved by adjusting the speed at which the wire is being advanced between two sheaves of the annealer in a manufacturing line. This also may be accomlished by adjusting the distance between the sheaves in an annealing leg of the annealer, or by adjusting the frequency of the applied power source.

22 Claims, 5 Drawing Sheets

METHODS OF AND APPARATUS FOR HEATING A MOVING METALLIC STRAND MATERIAL

TECHNICAL FIELD

This invention relates to methods of and apparatus for heating a moving metallic strand material. More particularly, it relates to methods of and apparatus for making an insulated conductor in which a moving metallic conductor wire is annealed in a manner which avoids variations in electrical heating energy that is applied to the wire.

BACKGROUND OF THE INVENTION

In the manufacture of insulated conductors such as those used in communications, metallic stock in the form of rod such as copper rod, for example, typically is reduced in diameter prior to covering it with a plastic insulation. This process is referred to as wire drawing and includes the step of advancing the rod through a plurality of successively smaller die openings to provide a wire which subsequently is insulated with a dielectric material such as a plastic material.

Each time the metallic conductor material is cold worked such as by causing it to be pulled through a die opening, the metallic grain structure is altered. This increases the number of dislocations through which electrons must travel during the flow of current. In other words, the resistivity of the resulting copper wire is increased through cold working.

In order to reduce the effects of cold working, the moving wire is annealed prior to plastic material being extruded thereover. The process of annealing is used to heat the moving wire for purposes of recovery, recrystallization and grain growth when sufficient thermal energy is available for grain growth. Annealing decreases the number of dislocations and consequently improves electron flow. Accordingly, the resistivity of the wire is decreased and its conductivity is increased.

It follows that the less the resistivity, the less the amount of copper which will be required to meet product specifications. With less copper required to satisfy product requirements, the amount of raw material is reduced, and the final cost of the product will be lowered.

After the wire has been annealed, it may, depending on the desired properties of the final product, be cooled. If it is cooled, then typically it is reheated in order to control more accurately the temperature of the wire as it enters an extruder in a tandem insulating line.

It has been found that copper wire is annealed more efficiently and more consistently on some tandem insulating lines than on others. Further, specific tandem lines seem to anneal copper wire better than other lines; that is, on some lines the annealing is more consistent for each successive increment of length of the wire than on others. Although there may be variations in equipment among tandem lines in a single manufacturing plant, there is one common denominator—the annealer.

Variations in the electrical energy imparted to the moving wire are undesirable. If such variations go uncontrolled, either more copper must be used through a larger cross section of the wire or more electrical power is used to compensate for the fluctuations in order to achieve desired properties. What is needed are methods and apparatus for inhibiting variations in the electrical energy imparted to the wire during annealing in order to optimize the amount of copper and electrical power used and to achieve increased conductivity.

It appears that the prior art has not yet addressed this problem. What is needed are methods and apparatus for heating a moving wire in such a manner that the energy imparted to each successive increment of length of the wire is substantially constant. Desirably, such methods can be implemented with a minimum amount of investment and minimal modifications of existing equipment.

SUMMARY OF THE INVENTION

The foregoing problems of the prior art have been overcome by the methods and apparatus of this invention. In a method of making an insulated conductor, a metallic wire is heated in a manner such that the amount of energy imparted to each portion of length of the wire is substantially constant. Successive increments of length of the wire are advanced from one sheave to another sheave. An alternating current is applied between the one sheave and the other sheave to cause each successive increment of length of the moving wire to be heated to anneal the wire. An integral number of half cycles of alternating current are caused to be applied to each successive increment of length of the wire, as the increments of its length are moved from the one sheave to the other sheave, to cause the energy applied to each successive increment of length of wire, as it is moved between the sheaves, to be substantially constant.

An integral number of half cycles of alternating current may be caused to be applied by any one of several techniques. In a preferred embodiment, the speed at which each successive increment of wire is advanced from the one sheave to the other sheave is adjusted to cause the number of half cycles of current to be an integral number. In the alternative, the distance between the one sheave and the other sheave may be adjusted to control the number of half cycles of current applied therebetween.

After the wire has been annealed, it may be cooled, reheated and then insulated with a dielectric material such as a plastic material. Then the insulated conductor is taken up.

BRIEF DESCRIPTION OF THE DRAWINGS

Other features of the present invention will be more readily understood from the following detailed description of specific embodiments thereof when read in conjunction with accompanying drawings, in which.

DETAILED DESCRIPTION

Figure 2:
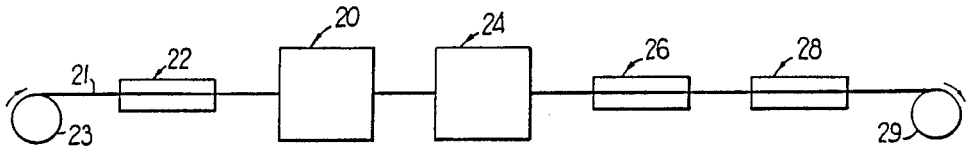
FIG. 2 is a schematic view of a manufacturing line for making insulated conductors.
Figure 1:
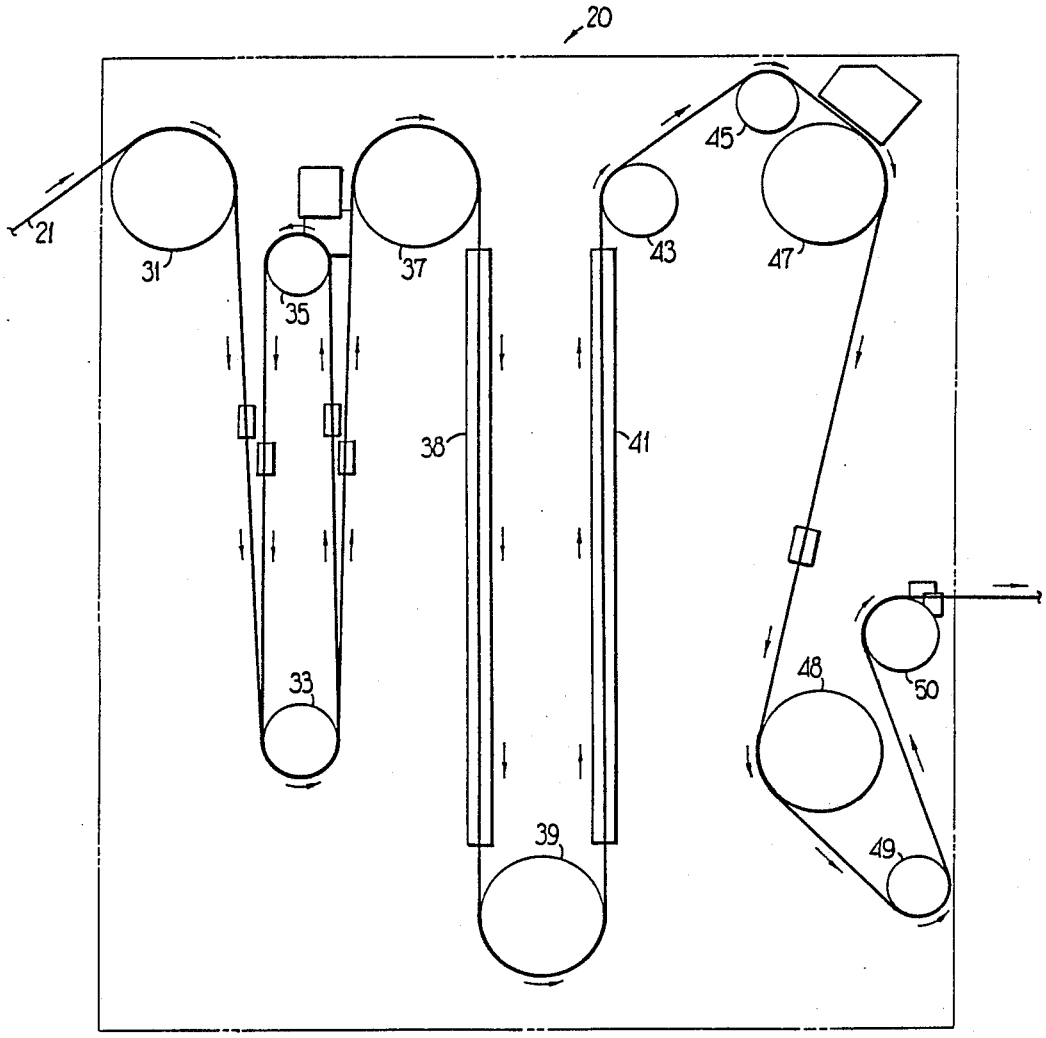
FIG. 1 is an overall schematic view of an apparatus which is used to anneal and to cool and then to reheat a moving metallic wire.

Referring now to FIG. 1, there can be seen a schematic view of a strand annealer 20 which is used to heat a moving metallic wire 21 such as a wire which is made of copper, for example. The wire 21 is provided in reducing the diameter of a supply of copper in rod form. The strand annealer 20 is used to heat successive increments of the moving wire 21 which have been moved from a supply 23 (see FIG. 2) through a wire drawing apparatus 22 and prior to their movement through an extruder 24 wherein an insulative plastic material is applied thereover. Afterwards, the insulated wire is moved through a cooling trough 26 by a capstan 28 and onto a takeup 29.

As the wire 21 is moved through the wire drawing apparatus 22, its gauge size is reduced and its grain structure is altered. This increases the number of dislocations through which electrons must travel during the flow of current. As a result, the resistivity of the wire is increased through cold working and its conductivity is decreased.

Annealing is a process in which the wire is heated to cause recovery, recrystallization and grain growth. This decreases the number of dislocations thereby increasing the conductivity and decreasing the resistivity. Advantageously, the less the resistivity, the less the amount of copper that is required to meet product specifications and the lower the electrical energy required for annealing.

Inasmuch as the annealing is so important to the final product, it becomes important to be able to achieve consistent results and to insure that the annealing of each successive increment of length of the wire is substantially constant. As discussed hereinbefore, this objective is not always achieved with prior art techniques. The methods of this invention result in that objective being met on a consistent basis.

The strand annealer 20 includes a first power sheave 31 over which the wire 21 is passed, and idler sheave 33, and an idler sheave 35. From the idler sheave 35, the wire 21 is passed again about the sheave 33 and then over a second power sheave 37. Then the wire is moved through a steam chest 38 and around a third power sheave which is designated 39 and which is submerged in a cooling medium such as water. After the wire 21 has been passed around the sheave 39, it is moved through a water chest 41, over idler sheaves 43 and 45, over a fourth power sheave 47, a fifth power sheave 48 and idler sheaves 49 and 50 into the extruder 24.

Annealing of the wire 21 is caused to occur between the first and third power sheaves 31 and 39 whereas between the third and fifth power sheaves 39 and 48, the wire is reheated. The reheating occurs after the wire has been cooled in the water chest 41. Reheating is used to be able to control the temperature at which the wire enters the extruder 24. It is far easier to control the temperature of the wire while its temperature is being increased than when it is being decreased. By suitable controlling the temperature of the wire through reheat, the adhesion of the plastic insulation to the metallic wire as well as expansion of some insulative materials is controlled.

In the annealing portion of the strand annealer 20, the wire 21 is heated by passing current through the wire from the first power sheave 31 to the second power sheave 37 and from the second power sheave 37 to the third power sheave 39. This is accomplished by causing the first and the third power sheaves to be at ground potential and the second power sheave 37 to be at a potential which is a function of parameters such as line speed and wire gauge size, for example, and which in a preferred embodiment is approximately 50 volts AC. This form of heating is commonly referred to as resistance annealing.

While the copper wire is being heated to its recrystallization state, it enters the steam chest 38 which is used to inhibit oxidation of the wire. The third power sheave 39 may or may not be submerged in a cooling medium. Afterwards, the wire 21 is quenched at the water level in the water chest 41. The quenching process is completed as the wire 21 exits the water chest. Resistance heating also is used in the reheating section with a voltage potential existing on the fourth power sheave 47 and ground potential on the third and the fifth power sheaves 39 and 48.

Figure 3:
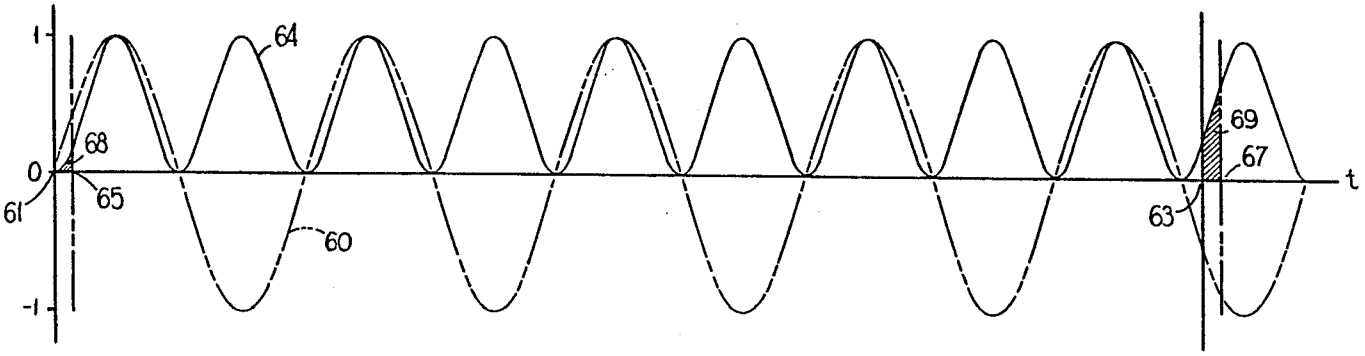
FIG. 3 is a schematic view of cycles of voltage and power applied between two power sheaves of FIG. 1.

Initially, assume that the wire is being moved at a speed of 4000 feet per minute. This equates to 66.67 feet per second or 0.90 cycles of alternating current per foot. In one embodiment, the distance between the second and the third power sheaves 37 and 39 is 5.10 feet. It follows that for a frequency of 60 Hz an incremental segment of length of the wire which is moved between the second and the third sheaves 37 and 39 is subject to the product of 0.90 cycles/ft. and 5.10 feet or 4.59 cycles which equates to 28.8398 radians. The 4.59 cycles of a waveform 60 are depicted in FIG. 3 from a point designated 61 to a point designated 63. Inasmuch as the voltage and current applied by the methods and apparatus of this invention are in phase, the waveform 60 is a plot of voltage corresponding to the applied alternating current with respect to time. The point 61 is at a time $t=0$ which corresponds to the time when an incremental segment of length of the wire is at the second power sheave 37 whereas the point 63 is at a time which corresponds to the time at which the incremental length of the wire reaches the third power sheave after having been subjected to the 4.59 cycles. The power is equal to current times voltage which is a sine squared function and is shown graphically by a waveform 64 in FIG. 3. Therefore, the relative energy which is delivered to the segment of the wire between the points 61 and 63 is determined by integrating the power between the limits of 0 and 28.8398 radians and is equal to 14.1937.

If the wire is moved one inch, for example, in a direction from the second power sheave 37 to the third power sheave 39, a second incremental wire segment which enters the annealer section at the second power sheave 37 and which ends at the third power sheave 39 also will be subject to 4.59 cycles, but the voltage to which the second incremental length is subjected initially will not be the same as for the first segment considered hereinbefore. The portion of the waveform, to which the second incremental length is subjected, begins at the point designated 65 (see again FIG. 3) and ends at a point designated 67. This equates to a shift at entry of the second incremental segment of 0.4712 radian which occurs in 0.00125 second. As a result, the initial voltage which is experienced by the second incremental segment is that corresponding to a time value of 0.00125 second. Also, the relative energy delivered to the second incremental segment of the wire which enters the annealer section between the power sheaves 37 and 39 at 0.00125 second after the first incremental segment can be calculated by integrating the sine squared function between the limits of 0.4712 radian and the sum of 28.8398 and 0.4712 radians and is found to be 14.4031.

This increase in relative energy can be seen in FIG. 3. The shaded portion designated 68 adjacent to the point designated 65 represents energy which is applied to the first incremental wire segment but not to the second. The shaded section 69, adjacent to the point 67, represents the energy which is applied to the second incremental wire segment but not to the first. It should be apparent from a study of FIG. 3 that more energy is applied to the second wire segment, which enters the annealing section between the sheaves 37 and 39 at point 65 on the waveform 60 at a time 0.00125 second after the first wire segment which enters the same annealing section but at point 61 on the waveform, than to the first incremental wire segment.

With each incremental one inch movement of the wire 21, the waveform is entered at a corresponding shift of 0.4712 radian. The energy delivered to a specific wire segment can be determined by integrating the power over 4.59 cycles with the limits of integration shifting 0.4712 radian with each one inch movement. It has been found that for a wire speed of 4000 feet per minute, the maximum relative energy is 14.6794 and the minimum is 14.1525. These variations are repetitive throughout the segment and the energy applied varies 3.72%. At some speeds, it has been found that energy variations approach 14%.

Figure 4:
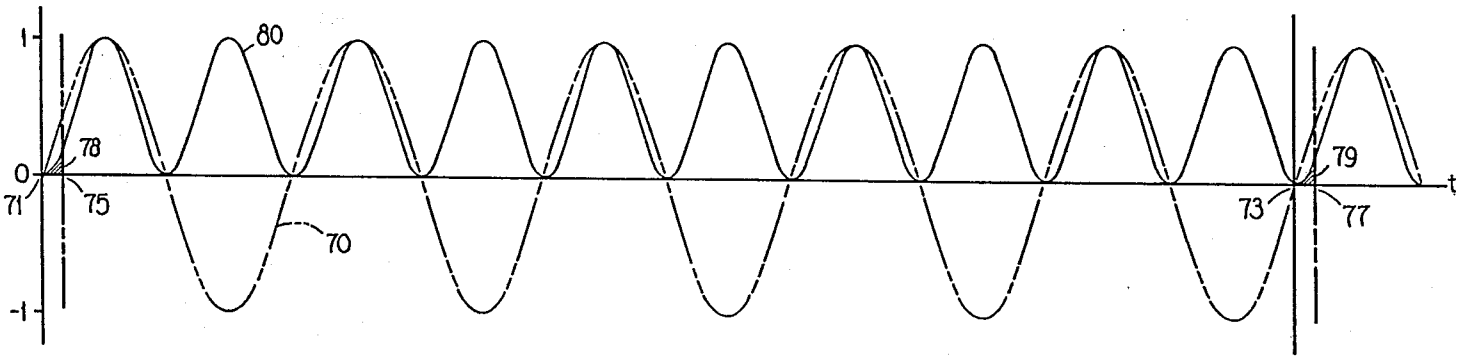
FIG. 4 is a schematic view of cycles of voltage and power applied between the two power sheaves of FIG. 1 after an adjustment has been made to control the number of half cycles of current which are applied to the wire between the two power sheaves.

Energy variations would be minimal by assuring that an integral number of half cycles of alternating current are applied to the moving wire. This can be seen by viewing a waveform 70 of FIG. 4. The amount of energy in the shaded portion designated 78 which is not applied to the second incremental length is equal to the amount of energy in the area 79 which is not applied to the first incremental length. Of course, variations in other factors such as power line fluctuations and copper quality may result in some energy variation.

It should be observed that energy variations may be controlled by applying an integral number of whole cycles of voltage, but this would reduce the number of points at which an annealer may be "tuned". The same results may be achieved with the capability of a broader range of tuning by applying an integral number of half cycles.

Any one of several parameters may be varied to insure that an integral number of half cycles of voltage are applied between two of the sheaves. The parameters that can be varied are the frequency of the wavefore, the distance between sheaves, waveform end points 71 and 73, or the speed at which the wire is being moved. Of these, the preferred embodiment is one in which the line speed is changed. For example, with the length between sheaves 37 and 39 being 5.10 feet, and waveform frequency, 60 Hz constant, one of the wire speeds at which energy variations are substantially eliminated is about 4090 feet per minute. It can be seen in FIG. 4 that when an incremental wire segment experiences the waveform from point 75 to 77 as compared to an incremental wire segment experiencing the waveform from point 71 to point 73, the area under a curve 80 that represents electrical energy applied to each of the incremental segments is the same.

Although the foregoing discussion has centered on the resistance heating of the wire 21 from the second power sheave 37 to the third power sheave 39, it will be recalled that heating of the wire is caused to occur also in a section between the first and the second power sheaves 31 and 37, respectively. That section is longer in the apparatus depicted in FIG. 1, so that less electrical power is being applied therealong. The length of the wire section between the first and the second power sheaves should be considered in the determination of preferred wire speeds. In the embodiment of the annealer 20 in which the length between the second and third power sheaves 37 and 39, respectively, is 5.10 feet, the length between the first and the second power sheaves 31 and 37, respectively, is 11.23 feet.

There is a family of wire speeds at which energy variations also are minimized. For example, speeds other than 4090 feet per second may be used to control the energy variations in the section of length between the power sheaves 37 and 39. This family is shown by an energy envelope designated 85 in FIG. 5, which corresponds to the section of wire length in the annealer between the first and the second power sheaves 31 and 37, and by an energy envelope designated 87, which corresponds to the section of wire length in the annealer between the second and the third power sheaves 37 and 39. The greater the width of an energy envelope in FIG. 5, the higher the energy variations in each wire segment. The narrow areas represent wire speeds that exhibit negligible energy variations applied to the wire from one incremental segment of length to another.

The amount of energy being applied in the two sections varies inversely with the length. Accordingly, for the annealer shown in FIG. 1, the proportion of the total energy in the section from the first power sheave 31 to the second power sheave 37 is 0.31 and for that between the second power sheave 37 and the third power sheave 39 is 0.69. These proportions also serve as a guide of relative importance of the two sections in optimizing a line speed that suits both sections. Further, not only must the relative lengths of the sections be considered, but also it must be determined where the maximum and minimum energies occur in each section. It would be imprudent to select a wire speed at which the variation in energy for a particular one inch segment of the wire is at a maximum in both sections at the same point in the wire inasmuch as these coincidental occurences would be additive and result in extreme variations in the heating of the wire. Ideally, the optimium wire speeds would be those at which the energy variations in both sections are simultaneously at a minimum.

Figure 5:
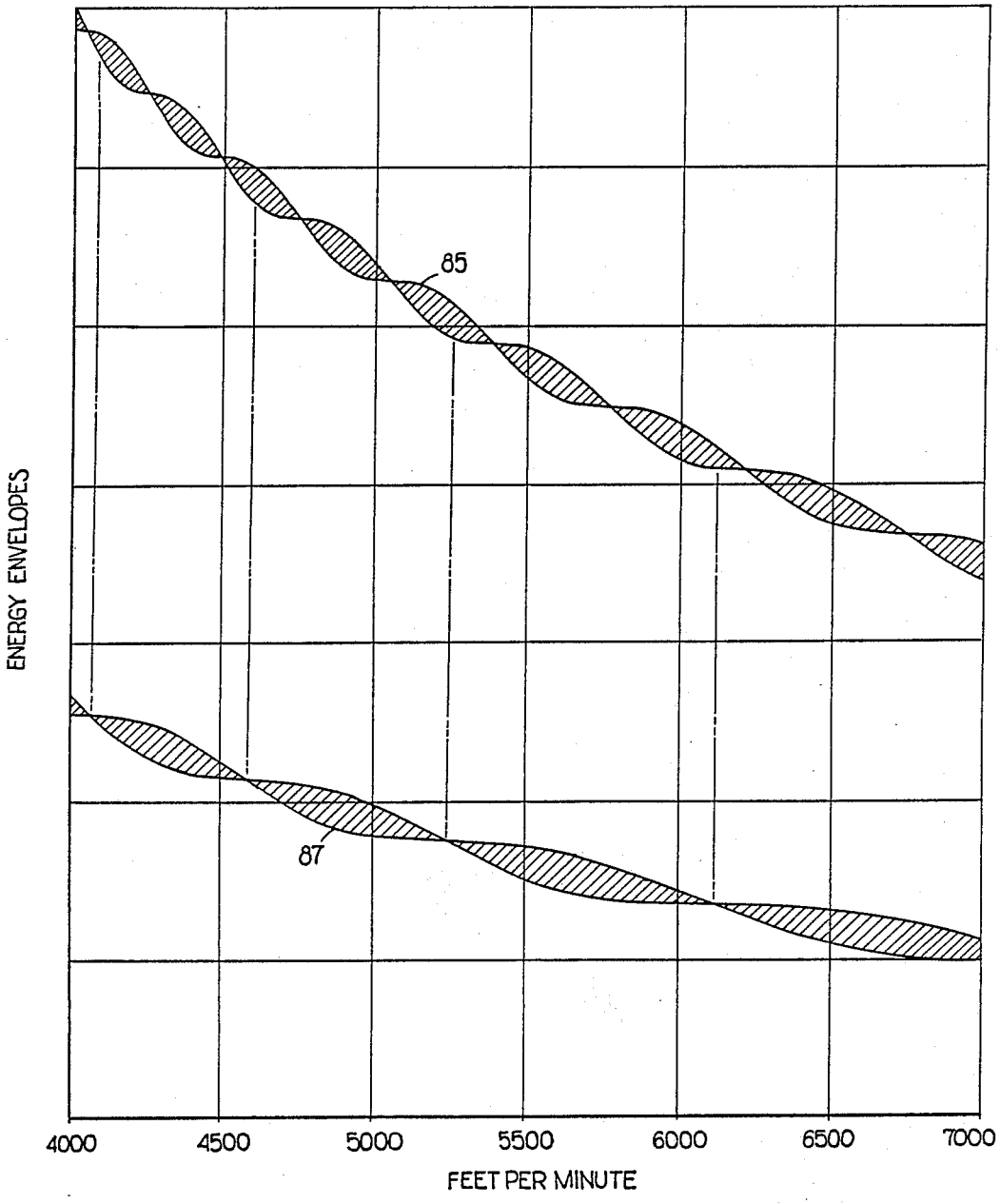
FIG. 5 is a graph which shows energy enevelopes for two sections of length of the wire.

The evaluation of the relative energy for the longer section provides run speeds which result in minimum energy variations for the longer section. Unfortunately, the preferred wire speeds for that section between power sheaves 31 and 37 are not the same as for the shorter section from the sheaves 37 to 39. This inconsistency between the two sections may be seen in FIG. 5 which shows plots of the energy variations for each section. In FIG. 5, the bottom plot represents the 5.10 foot section and the upper plot represents the 11.23 foot section. As can be seen, there are no points where both envelopes minimize at the same point. However, if the section lengths were an integral relationship to each other, some of their minimum energy variations would coincide.

Figure 6:
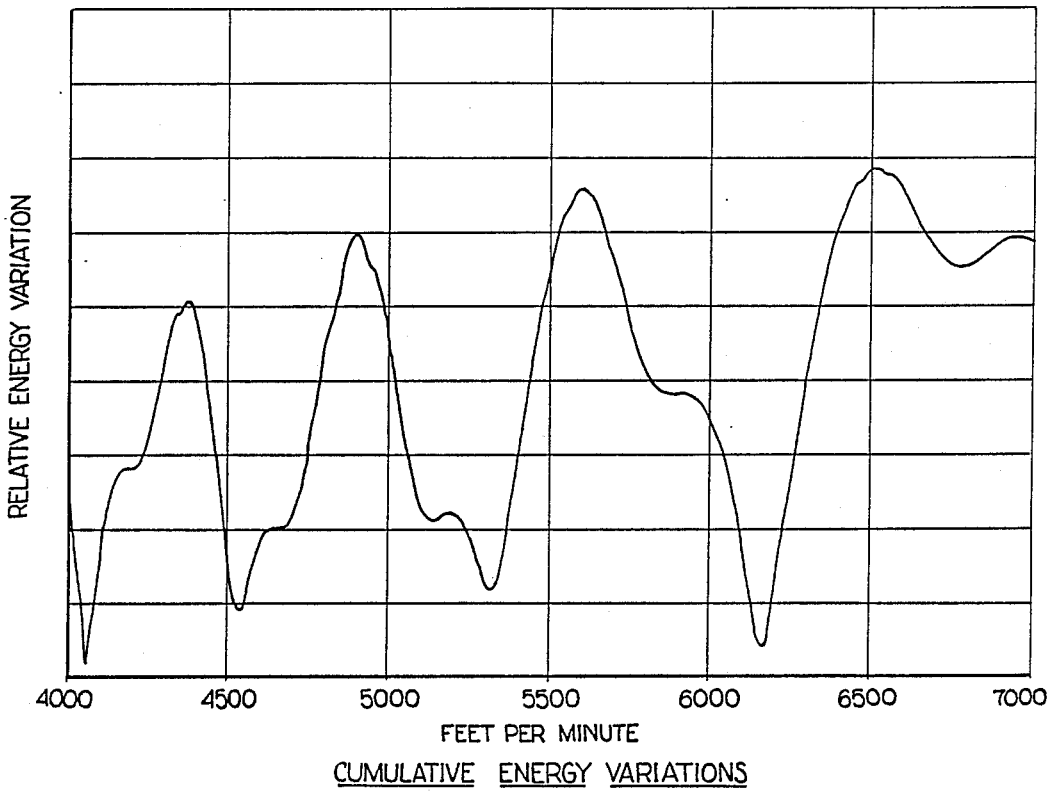
FIG. 6 is a graph showing conductive energy variations considering a first power sheave to a second power sheave as well as the second power sheave to a third power sheave.

It is also possible, recognizing the relative amounts of heating in the two sections to determine the optimum wire speed for both section lengths simultanenously. A summation of the two relative energies is evaluated for each power sheave-to-power sheave section at increments of 10 feet per minute. The results are shown in FIG. 6. The points where the waveform minimizes represent preferred wire speeds at which variability in the total annealing process is reduced.

If energy variation is at a minimum, electrical power is being used as economically as possible. At non-preferred speeds, either excess electrical energy is being used or larger wire diameters are introduced to assure appropriate electrical conductivity.

Figure 7:
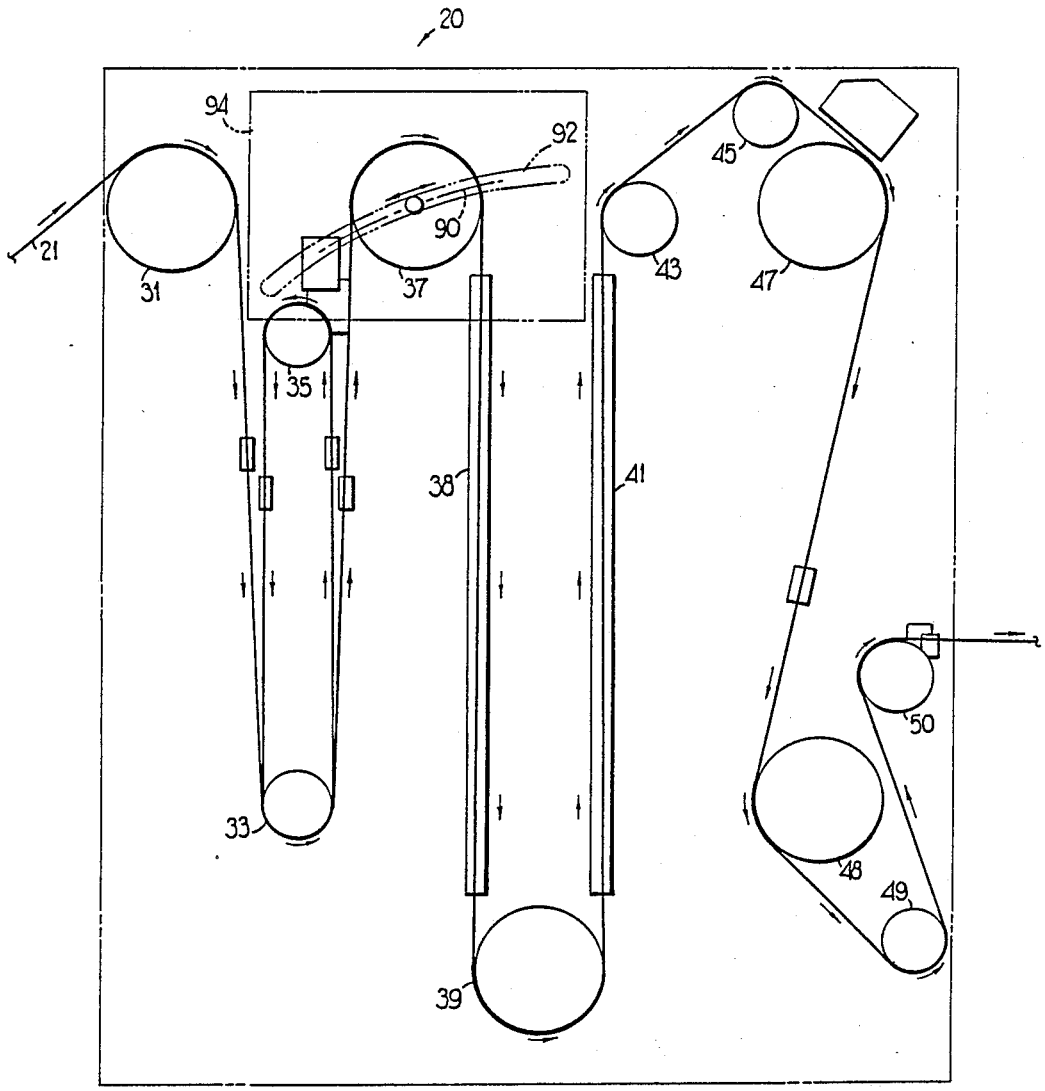
FIG. 7 is a schematic view which shows the variable location of one of the power sheaves of the annealer of FIG. 1 in order to cause the number of half cycles of current applied between each of two pairs of sheaves to be an integer.

A further embodiment of this invention is depicted in FIG. 7. There, the second power sheave 37, may be mounted at any location along a curve 90. This may be accomplished by mounting the second power sheave 37 rotatably about a shaft which may occupy any position along an acurate slot 92 in a plate 94. The locus of points along the curve 90 is such that for any one point which corresponds to the center of the power sheave 37, the wire section length from the power sheave 31 to the power sheave 37 will be twice the wire section length from the power sheave 37 to the power sheave 39. The section lengths can be changed to match the speed to allow an integral number of half cycles of voltage to be applied to each section while maintaining the same length ratio.

It is to be understood that the above-described arrangements are simply illustrative of the invention. Other arrangements may be devised by those skilled in the art which will embody the principles of the invention and fall within the spirit and scope thereof.

What is claimed is:

1. A method of making an insulated conductor, said method comprising the steps of:

advancing successive increments of a length of a metallic wire from one sheave to another at a predetermined speed, the one sheave being a predetermined distance from the other sheave with each successive increment being substantially less than the distance between the sheaves;

heating successive increments of the length of the moving wire between the sheaves by applying an alternating current between the sheaves;

causing the speed at which the wire is advanced and the distance between the sheaves to be such that an integral number of half cycles of the alternating current are caused to be applied to each successive increment of length of the wire as each successive increment of length of the wire is moved from the one sheave to the other sheave to cause the energy applied to each successive increment of length of the wire to be substantially constant;

applying an insulative covering to successive increments of length of the moving wire; and taking up the insulated wire.

2. The method of claim 1, wherein said step of heating is accomplished by changing the speed at which the successive increments of length of the wire are advanced from the one sheave to the other sheave.

3. The method of claim 1, wherein said step of heating is accomplished by adjusting the distance between the sheaves until an integral number of half cycles of alternating current are applied to each increment of wire as it is moved between the sheaves.

4. The method of claim 1, wherein each successive increment of length of the wire is advanced from a first sheave to a second sheave and then from the second sheave to a third sheave and with the first and third sheaves being at ground potential and the second sheave at a predetermined voltage potential, wherein a predetermined portion of the heating of the wire is accomplished as the wire is moved from the second sheave to the third sheave, and wherein an integral number of half cycles of the alternating current are applied to each successive increment of the wire which is moved between the first and the second sheaves and to that which is moved between the second and third sheaves.

5. The method of claim 4, wherein the sheaves are spaced apart so that the distance from the first sheave to the second sheave is an integral multiple of the distance between the second and the third sheaves.

6. The method of claim 4, wherein the position of the second sheave is such that the distance between the first and the second sheaves is an integral multiple of the distance between the second and the third sheaves and is such that at the speed of which the wire is being moved, the energy variations among successive increments of the wire are minimized.

7. The method of claim 1, wherein said step of heating is accomplished by adjusting the frequency of the alternating current which is applied to each successive increment of length of the wire.

8. A method of heating a wire in a manner such that the amount of energy imparted to each portion of length of the wire is substantially constant, said method including the steps of:

advancing successive increments of length of a metallic wire at a predetermined speed from one sheave to another sheave which is spaced a predetermined distance from said one sheave;

applying an alternating current between the sheaves to cause the length of the wire which is moved between the one sheave and the other sheave to be heated; and causing the speed at which the wire is advanced and distance between the sheaves to be such that an integral number of half cycles of the alternating current are caused to be applied to each successive increment of the length of the wire between the sheaves as the wire is moved from the one sheave to the other sheave to cause the energy applied to each successive increment of the wire to be substantially constant.

9. The method of claim 8, wherein said step of causing is accomplished by changing the speed at which the successive increments of length of the wire are advanced from one sheave to the other sheave.

10. The method of claim 8 wherein said step of causing is accomplished by adjusting the distance between the sheaves until an integral number of half cycles of alternating current are applied to each increment of wire as it is moved between the sheaves.

11. The method of claim 8, wherein each successive increment of length of the wire is advanced from a first sheave to a second sheave and then from the second sheave to a third sheave and with the first and third sheaves being at ground potential and the second sheave at a predetermined voltage potential, wherein a predetermined portion of the heating of the wire is accomplished as the wire is moved from the second sheave to the third sheave, and wherein an integral number of half cycles of an alternating current are applied to each successive increment of the wire as increments of its length are moved from the first sheave to the second sheave and as the increments are moved from the second to the third sheave.

12. The method of claim 11, wherein the sheaves are spaced apart so that the distance from the first sheave to the second sheave is an integral multiple of the distance between the second and the third sheaves.

13. The method of claim 11, wherein the position of the second sheave is such that the distance between the first and the second sheaves is an integral multiple of the distance between the second and the third sheaves and is such that at the speed of which the wire is being moved, the energy variations among successive increments of the wire are minimized.

14. The method of claim 8, wherein said step of causing also is accomplished by adjusting the frequency of the alternating current which is applied to each successive increment of length of the wire.

15. An apparatus for making an insulated metallic conductor, said apparatus including:

supply means for holding a length of metallic wire;

moving means for advancing each successive increment of length of the wire along a path of travel at a predetermined speed;

wire drawing means for reducing the diameter of the metallic wire;

an annealer which comprises:

first and second sheaves which are arranged to define a portion of the path of travel and which are spaced apart a predetermined distance; and means for applying an alternating current between said first and said second sheaves to cause each successive increment of a length of the moving wire extending between said first and second sheaves to be heated, said moving means and the disposition of said first and second sheaves being such that an integral number of half cycles of alternating current are caused to be applied to each successive increment of the length of the wire as each successive increment is moved from said first sheave to said second sheave;

extrusion means for insulating the metallic wire;

means for cooling the insulated metallic wire; and means for taking up the insulated wire.

16. An apparatus for heating a wire in a manner such that the amount of energy which is imparted to each portion of length of the wire is substantially constant, said apparatus including:

moving means for advancing successive increments of length of a metallic wire at a predetermined speed along a path of travel;

first, second and third sheaves which are arranged to define the path of travel with the sheaves being spaced predetermined distances apart;

means for causing the wire to be moved from said first to said second sheave and from said second to said third sheave in a plurality of loops; and means for applying an alternating current between said first and said second sheaves and between said second and said third sheaves to cause each successive increment of a length of the moving wire extending between said first and second sheaves to be heated, said moving means and the disposition of said first, second and third sheaves being such that an integral number of half cycles of alternating current are caused to be applied to each successive increment of the length of the wire as each successive increment is moved from said first sheave to said second sheave and from said second sheave to said third sheave.

17. The apparatus of claim 16 which also includes means for adjusting the frequency of the alternating current.

18. The apparatus of claim 16, wherein the distance between said first and second sheaves and between said second and third sheaves is such that an integral number of half cycles of current are applied to each increment of length of the wire as it is moved between said first and second sheaves and between said second and third sheaves.

19. The apparatus of claim 18, wherein said sheaves are spaced apart so that the distance from said first sheave to said second sheave is an integral multiple of the distance between said second and said third sheaves.

20. The apparatus of claim 18, which also includes means for mounting said second sheave for movement to any one of a plurality of positions such that the distance between said first and said second sheaves is always an integral multiple of the distance between said second and said third sheaves and is such that at the speed at which the wire is being moved, the energy variations applied to successive increments of length of the wire are minimized.

21. An insulated metallic conductor which is made in accordance with the method of claim 1.

22. A metallic conductor wire which has been heated in accordance with the method of claim 8.

* * * * *